US010927834B2

(12) United States Patent
Buergy et al.

(10) Patent No.: US 10,927,834 B2
(45) Date of Patent: Feb. 23, 2021

(54) METHOD OF OPERATING A LUBRICATING DEVICE, LUBRICATING DEVICE AND COMPRESSOR WITH SUCH A LUBRICATING DEVICE

(71) Applicants: Armin Buergy, Bruehl (DE); Dieter Hess, Lambsheim (DE); Andreas Schoenfeld, St. Leon-Rot (DE); Stefan Schuermann, Walldorf (DE)

(72) Inventors: Armin Buergy, Bruehl (DE); Dieter Hess, Lambsheim (DE); Andreas Schoenfeld, St. Leon-Rot (DE); Stefan Schuermann, Walldorf (DE)

(73) Assignee: SKF LUBRICATION SYSTEMS GERMANY GMBH, Walldorf (DE)

( * ) Notice: Subject to any disclaimer, the term of this patent is extended or adjusted under 35 U.S.C. 154(b) by 853 days.

(21) Appl. No.: 14/644,782

(22) Filed: Mar. 11, 2015

(65) Prior Publication Data

US 2015/0260185 A1 Sep. 17, 2015

(30) Foreign Application Priority Data

Mar. 12, 2014 (DE) ..... 102014204542.8

(51) Int. Cl.
*F04C 15/00* (2006.01)
*F01M 1/02* (2006.01)
(Continued)

(52) U.S. Cl.
CPC ..... *F04C 15/0092* (2013.01); *F01M 1/02* (2013.01); *F01M 1/16* (2013.01); *F04B 49/065* (2013.01);
(Continued)

(58) Field of Classification Search
CPC ..... F04C 2/08–084; F04C 2/12; F04C 11/005–006; F04C 2/084; F04C 11/006;
(Continued)

(56) References Cited

U.S. PATENT DOCUMENTS 3,187,734 A * 6/1965 Yingst ..... F02M 41/06 123/179.17
3,587,079 A * 6/1971 Obergefell ..... G01N 21/534 184/6.4
3,770,239 A * 11/1973 Stobbe ..... A61M 5/1689 128/DIG. 13
4,262,775 A * 4/1981 Webb ..... F01M 1/16 137/115.26
(Continued)

FOREIGN PATENT DOCUMENTS

DE 10213598 A1 10/2002
DE 60303061 7/2006
(Continued)

*Primary Examiner* — Alexander B Comley
(74) *Attorney, Agent, or Firm* — J-Tek Law PLLC; Scott T. Wakeman; Mark A. Ussai

(57) ABSTRACT

A lubricant supplying device includes a feed pump that serves to pump lubricant from a lubricant reservoir to at least one lubrication point. A method for operating the lubricant supplying device includes measuring at least one operating parameter, such as temperature (T), of at least one part of a system to be lubricated and/or of the lubricant and/or of the environment. The at least one measured operating parameter (T) is supplied to a controller, where a required volumetric flow ($\dot{V}_{target}$) of lubricant is determined based on a stored functional relationship ($\dot{V}_{target}=f$ (T)) that generates the required volumetric flow ($\dot{V}_{target}$) based upon the measured operating parameter (T). The feed pump is then actuated in order to achieve the determined, required volumetric flow ($\dot{V}_{target}$).

4 Claims, 3 Drawing Sheets

(51) Int. Cl.

| | |
|---|---|
| ***F01M 1/16*** | (2006.01) |
| ***F04C 11/00*** | (2006.01) |
| ***F04B 49/10*** | (2006.01) |
| ***F04B 49/06*** | (2006.01) |
| ***F04C 2/08*** | (2006.01) |
| ***F04C 14/08*** | (2006.01) |

(52) U.S. Cl.
CPC ..... *F04B 49/106* (2013.01); *F04C 2/084* (2013.01); *F04C 11/006* (2013.01); *F04C 14/08* (2013.01); *F01M 2001/0215* (2013.01); *F04C 2270/205* (2013.01)

(58) Field of Classification Search
CPC .. F04C 14/08; F04C 15/0092; F04B 39/0207; F04B 23/10–12; F04B 23/106; F04B 49/065; F04B 49/106; F01M 1/02; F01M 1/16; F01M 2001/0215
USPC ..... 417/2, 13, 32, 43, 44.1, 44.2, 246, 247, 417/244, 206, 205; 184/6.16, 6.5, 6.8, 184/6.9, 6.12, 27.2; 123/196 R; 180/190
See application file for complete search history.

(56) References Cited

U.S. PATENT DOCUMENTS

| | | | | |
|---|---|---|---|---|
| 5,154,585 | A * | 10/1992 | Spencer | F01M 9/108 417/364 |
| 5,310,020 | A | 5/1994 | Martin et al. | |
| 6,739,305 | B2 | 5/2004 | Takahara et al. | |
| 6,941,922 | B2 | 9/2005 | Williams et al. | |
| 2009/0035121 | A1 * | 2/2009 | Watson | F01C 1/126 415/1 |
| 2009/0158727 | A1 * | 6/2009 | Bitter | F04B 23/04 60/428 |
| 2010/0163327 | A1 * | 7/2010 | Bernier | B62M 27/02 180/190 |

FOREIGN PATENT DOCUMENTS

| | | | |
|---|---|---|---|
| DE | 102012220298 | A1 | 5/2014 |
| EP | 2562463 | A2 | 2/2013 |
| JP | 2010024926 | A | 2/2010 |
| WO | 2009002572 | A1 | 12/2008 |
| WO | 2013181709 | A1 | 12/2013 |

* cited by examiner

METHOD OF OPERATING A LUBRICATING DEVICE, LUBRICATING DEVICE AND COMPRESSOR WITH SUCH A LUBRICATING DEVICE

CROSS-REFERENCE TO RELATED APPLICATION

This application claims priority to German patent application no. 10 2014 204 542.8 filed on Mar. 12, 2014, the contents of which are fully incorporated herein by reference.

TECHNICAL FIELD

The invention relates, in one aspect of the present teachings, to a method for operating a lubricating device for the pumping of lubricant to at least one lubrication point, which lubricating device comprises a feed pump for pumping lubricant from a lubricant reservoir to the at least one lubrication point. Furthermore, in other aspects of the present teachings, the invention relates to a lubricating device and to a compressor including such a lubricating device.

BACKGROUND

For example, compressors for providing compressed air are provided with a compressor lubrication system that is configured as a total loss oil lubrication system. In this case, a defined quantity of lubricant per time is fed, via a lubrication system of the above-described type, to the compressor parts that are movable relative to one another, wherein the setting of the volumetric flow (amount of lubricant per time) is manually set. However, constantly changing primary or secondary operating conditions change the lubricant requirements. Primarily a compressor requires, e.g., under full load, more lubricating oil than a compressor in partial-load- or no-load-operation. Secondarily, for example, a temperature change in the environment of the lubrication system changes the viscosity of the lubricating oil, which leads to a change in the pumped volume.

A manually-set lubrication system does not adapt itself to the new conditions, but rather only pumps the optimal quantity of lubricant per time for a single operating state. With deviations from this ideal operating state, too much or too little lubricating oil is pumped depending on the conditions, which leads to an under- or over-lubrication of the lubrication point.

An under-lubrication leads to increased wear and thus in the present case to the failure of the compressor (for example of a compressor). An over-lubrication, however, burdens the environment and, in the case of gas compressors, contaminates the product to be pumped, whereby it is categorized as inferior and must be sold lower-priced.

In the known compressor lubrication system, the pumped volumetric flows are manually corrected only when the operating conditions change significantly, if this is, however, recognized at all. A pumped quantity change, which is permanently and finely adapted to the operating conditions, has not been performed to date. In this respect, to date no adapting of the pumped quantities per time takes place. An over-lubrication of the lubrication point in principle is therefore typical as a consequence of imprecise volumetric-flow setting.

SUMMARY

In one aspect of the present teachings, a method for operating a lubricating device for the pumping of lubricant as well as a corresponding device are disclosed, using which the above-mentioned problem is avoided. Accordingly, even if the operating conditions change, an optimal lubrication can always take place, whereby both an over-lubrication and an under-lubrication can be prevented.

Exemplary embodiments relate to a method for operating the lubricating device that preferably includes the steps:

a) measuring of at least one operating parameter of at least one part of a system to be lubricated and/or of the lubricant and/or of the environment;

b) supplying of the at least one measured operating parameter to a controlling- or regulating-device and determining of a required volumetric flow of lubricant based on a stored functional relationship between the required volumetric flow and the operating parameter; and c) activating of the feed pump in accordance with the volumetric flow determined according to step b).

In this case, the current volumetric flow of the feed pump is preferably measured and compared to the determined volumetric flow, wherein deviations between these values are reduced by the controlling- or regulating-device.

The feed pump preferably comprises a stepper motor, wherein the controlling- or regulating-device outputs a step number, which corresponds to the required volumetric flow, to the stepper motor for driving the feed pump.

The measured operating parameter is preferably a temperature, e.g., the ambient temperature.

The lubricating device for the pumping of lubricant preferably comprises a feed pump for pumping lubricant from the lubricant reservoir to the at least one lubrication point, wherein the device preferably includes:

at least one measuring means, e.g., a temperature sensor, for measuring at least one operating parameter of at least one part of a system to be lubricated and/or of the lubricant and/or of the environment; and a controlling- or regulating-device, which is configured to determine, depending on the supplied measured value of the operating parameter, a required volumetric flow of lubricant based on a stored functional relationship between the required volumetric flow and the operating parameter and to control the feed pump in accordance with the determined volumetric flow.

The device furthermore preferably comprises a measuring means for measuring the current, actual volumetric flow pumped by the feed pump. This measuring means can be configured as a drop measuring apparatus that utilizes a photoelectric sensor.

The feed pump preferably includes a stepper motor and a gear pump coupled thereto.

The feed pump, together with its actuator and the measuring means for measuring the current volumetric flow being pumped by the feed pump, can be configured as a metering stage, which is connected with a pressure stage, wherein the pressure stage includes a continuously driven pumping element, e.g., a pressurizing piston; lubricant pumped by the feed pump can be pumped to the lubrication point using the pressurizing piston.

Exemplary embodiments further relate to a compressor for generating compressed air, including a lubricating device as was described above.

Accordingly, exemplary embodiments apply to a lubricant pump including an integrated controller or regulator, which automatically adapts to changing operating conditions (e.g., temperature, viscosity, lubricant requirements). The controller or regulator allows for a remote querying of the system parameters and a step-less regulation of the pumping quantity.

A, for example, radially operating stepper motor can be connected to a gear pump via a coupling. This gear pump suctions lubricating oil from a reservoir and pumps it to a volumetric control. The volumetric control, which with very small quantities can be configured as a drop control in the form of a photoelectric sensor, detects the number of drops and transmits it as a signal to the controller or regulator. Simultaneously a temperature sensor detects the environmental- or oil-temperature, from which the controller or regulator calculates a compensation value, for example, using predetermined and stored viscosity curves, and accordingly takes into account the run time or the activation of the stepper motor.

If the target- and actual-value differ, then the controller or the regulator changes the run time of the stepper motor—and thus of the pump—such that the target- and actual-value match. This process is repeated continuously, whereby a control loop results.

In this manner it can be ensured that the volumetric flow of the pumped lubricating oil is always held constant. The optimal supplying of the lubrication point with lubricant is provided.

Depending on need, if required an intermediate lubricating can be triggered, or the lines can be rapidly vented with a constant pumping volume; generally the lubricant quantity per time can be individually adapted and monitored.

The system is preferably constructed in two stages. The exact metering and regulation of the lubricant quantity takes place in a metering stage. In a second stage, the pressure stage, the lubricant quantity provided in the metering stage is pumped to the lubrication point under high pressure. The pumped oil thereby reaches, via bores before a pressurizing piston, for example, a feed pump, which pumps the lubricant under high pressure to the outlet. In this case only so much oil is pumped as was supplied to the pressurizing piston in the metering stage. Preferably the movement of the pressurizing piston is constantly effected by its own or an external actuator that can be embodied as an eccentric shaft.

The proposed system operates without mechanical adjustments. An automatic and need-based adapting of the optimal volumetric flow of lubricant to the operating conditions is possible via the control loop. The lubricating system can thereby deliver to the lubrication point exactly that quantity of lubricant that is really needed.

An over-lubrication, such as is mandatorily required in many other systems due to unfavorable volumetric flow settings, can be avoided. A need-based lubrication protects the environment and saves costs. In addition, a monitoring of the pumped quantity of lubricant is possible.

The controller or regulator can be embodied as an integrated or as an external unit. Signals concerning the lubricant requirements and the operating conditions can also be transmitted from the lubrication point to the controller or regulator. The signals are compared and the required adjustments of the pump are determined.

The electrical components of the system offer the possibility of remote monitoring and remote adjusting. A sight glass or additional LEDs make(s) possible a functional control even directly at the pumping element. Using push buttons, it can be made possible to manually change the basic settings of the pump.

The volumetric control not only serves for volumetric flow detection, but also for functional control. When malfunctions occur that influence the volumetric flow (for example, failure of the actuator for the pressurizing piston or a too-low fill level in the oil reservoir), the control loop does not manage to set the target volumetric flow rate; in this case an error message is output.

The following should be noted with respect to the preferably used stepper motor for the actuator of the feed pump for the oil:

The stepper motor can be configured as a reluctance stepper motor or as a permanent-magnet stepper motor.

A stepper motor is usually a synchronous motor, wherein the rotor, i.e., the rotatable motor part together with the shaft, can be rotated by a controlled stepwise-rotating electromagnetic field of the stator coils, i.e., of the non-rotatable motor part, about a minimum angle (step) or its multiple.

If the stepper motor is embodied as a reluctance motor, the rotor is comprised of a toothed soft-iron core. With this material, the magnetic field dissipates after the switching off of the stator current. When current is switched-on, the magnetic flux flows through the soft iron core of the rotor. The rotational movement of the rotor is achieved because the nearest tooth of the rotor is attracted by the toothed stator since the magnetic resistance thus decreases.

If the stepper motor is configured as a permanent-magnet stepper motor, the stator is comprised of soft iron and the rotor is comprised of permanent magnets, which alternatingly have a north- and a south-pole. The permanent-magnetic rotor is oriented by the stator magnetic field, such that a rotational movement results.

The proposed lubricating device can be used particularly advantageously anywhere where, despite changing operating conditions, small pumped volumes must be held at a constant level, e.g., in compressor lubrication.

BRIEF DESCRIPTION OF THE DRAWINGS

Further advantageous designs are described in more detail below with reference to exemplary embodiments depicted in the drawings, but are not limited to said exemplary embodiments.

DETAILED DESCRIPTION

Figure 1:
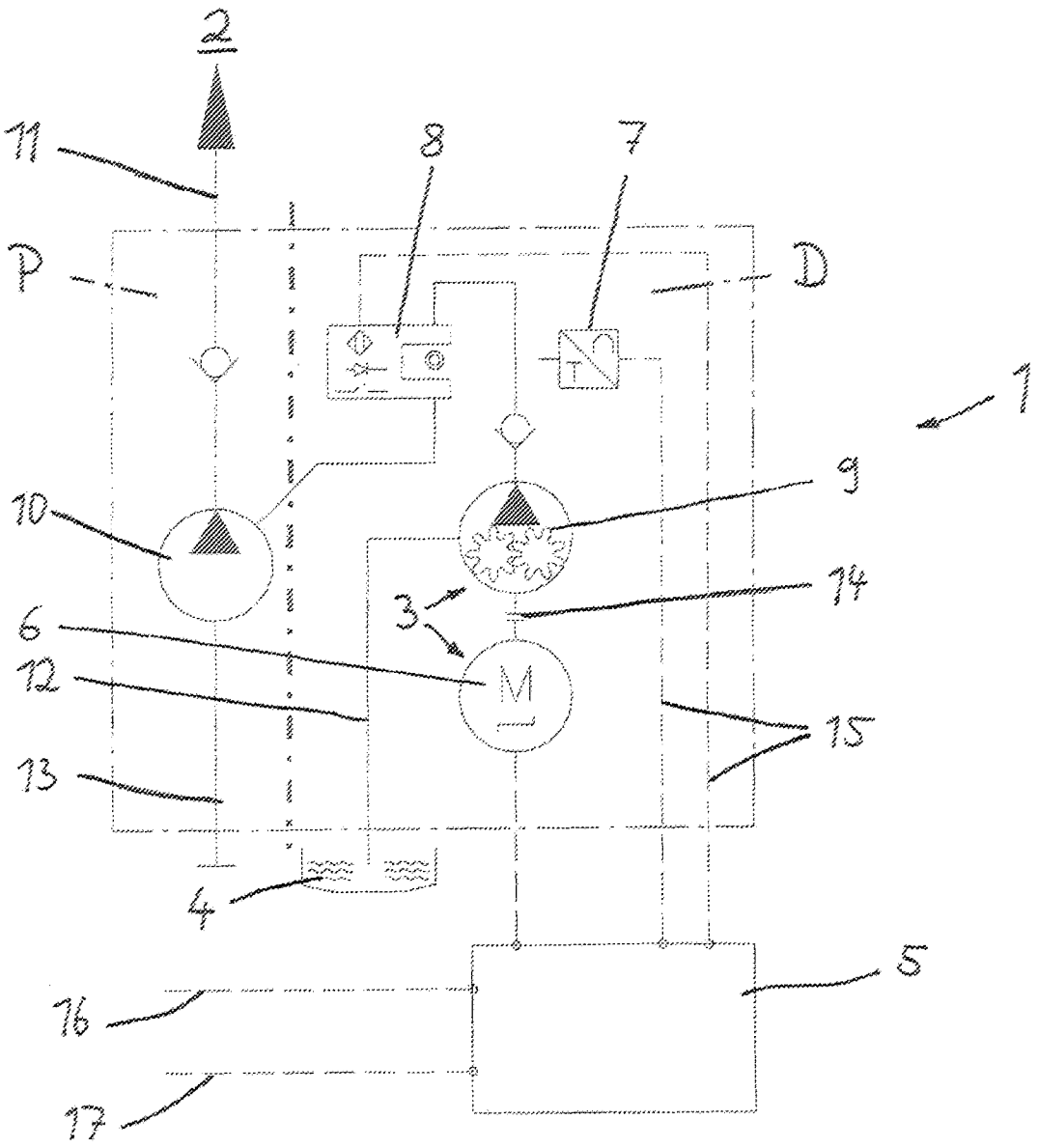
FIG. 1 schematically shows a lubricating device for supplying a lubrication point with a defined quantity of lubricant per time.

In FIG. 1 the structure of a lubricating device 1 is schematically depicted, as results according to a first design of the invention. Lubricating oil is pumped out from a lubricant reservoir 4 to a lubrication point 2. Here the lubricating oil is metered in a metering stage D, i.e., the volumetric flow (volume per time) is defined, while the metered oil is then pumped, in a pressure stage P, to the lubrication point 2.

A feed pump 3 is provided for metering the oil, which pump is comprised of a stepper motor 6 that is connected to a gear pump 9 via a coupling 14. By application of appropriate step impulses by a controlling device or regulating device 5, smallest quantities of oil can thus be supplied in a metered manner in the pressure stage P.

In the pressure stage P, a pumping element 10 in the form of a pressurizing piston takes care of the supplying of the oil to the lubrication point 2. The pressurizing piston 10 is driven by an actuator 13 (which is depicted in more detail in FIG. 3).

It is important that a change in the operating conditions is detected by the lubricating device 1 and is taken into consideration in the pumping of lubricating oil. For this purpose a temperature sensor 7 is present, which—generally speaking—measures an operating parameter, here in the form of the temperature T, of a part of the system to be lubricated, or of the lubricant, or of the environment. The measured value of the temperature sensor 7 is supplied to the controlling- or regulating-device 5. A function is stored therein, which expresses a target volumetric flow $\dot{V}_{target}$ in accordance with the measured temperature T, i.e., a functional relationship $\dot{V}_{target}=f(T)$ between the required volumetric flow $\dot{V}_{target}$ and the operating parameter T is stored. The activation of the feed pump 3 is then effected in accordance with the thus-determined volumetric flow $\dot{V}_{target}$.

The current volumetric flow $\dot{V}_{actual}$, i.e., the actual volumetric flow, is determined by a volumetric-flow measuring element 8. By feeding back this actual value, the regulating device 5 can hold the volumetric flow to the pre-specified, desired value. Corresponding signal lines 15 feedback the measured values from the sensors 7 and 8 to the regulating device 5.

Figure 2:
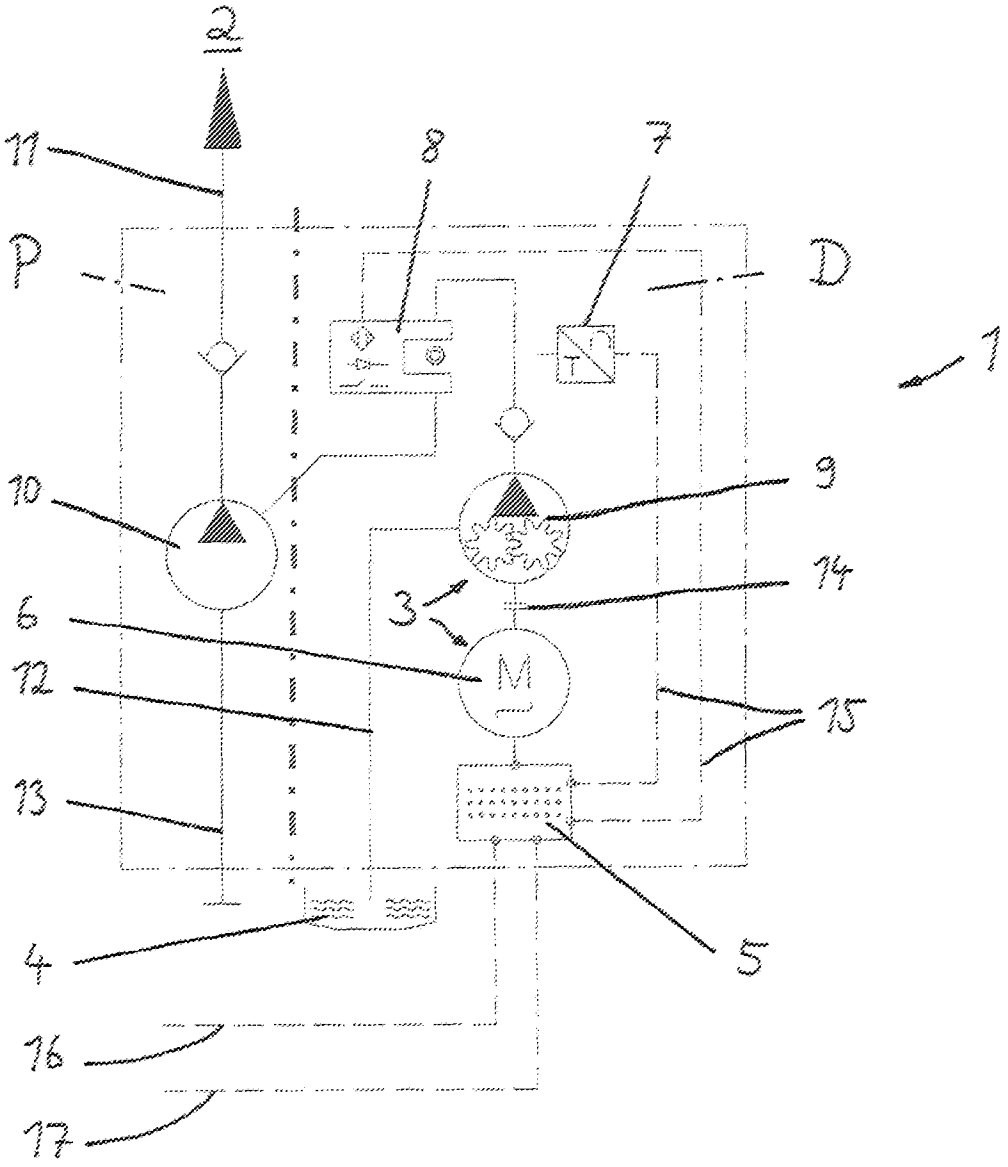
FIG. 2 shows a slightly modified solution to that according to FIG. 1.

In FIG. 1 the regulating device 5 is shown separated as such from the lubricating device 1; in the solution according to FIG. 2 it is integrated into the device.

Figure 3:
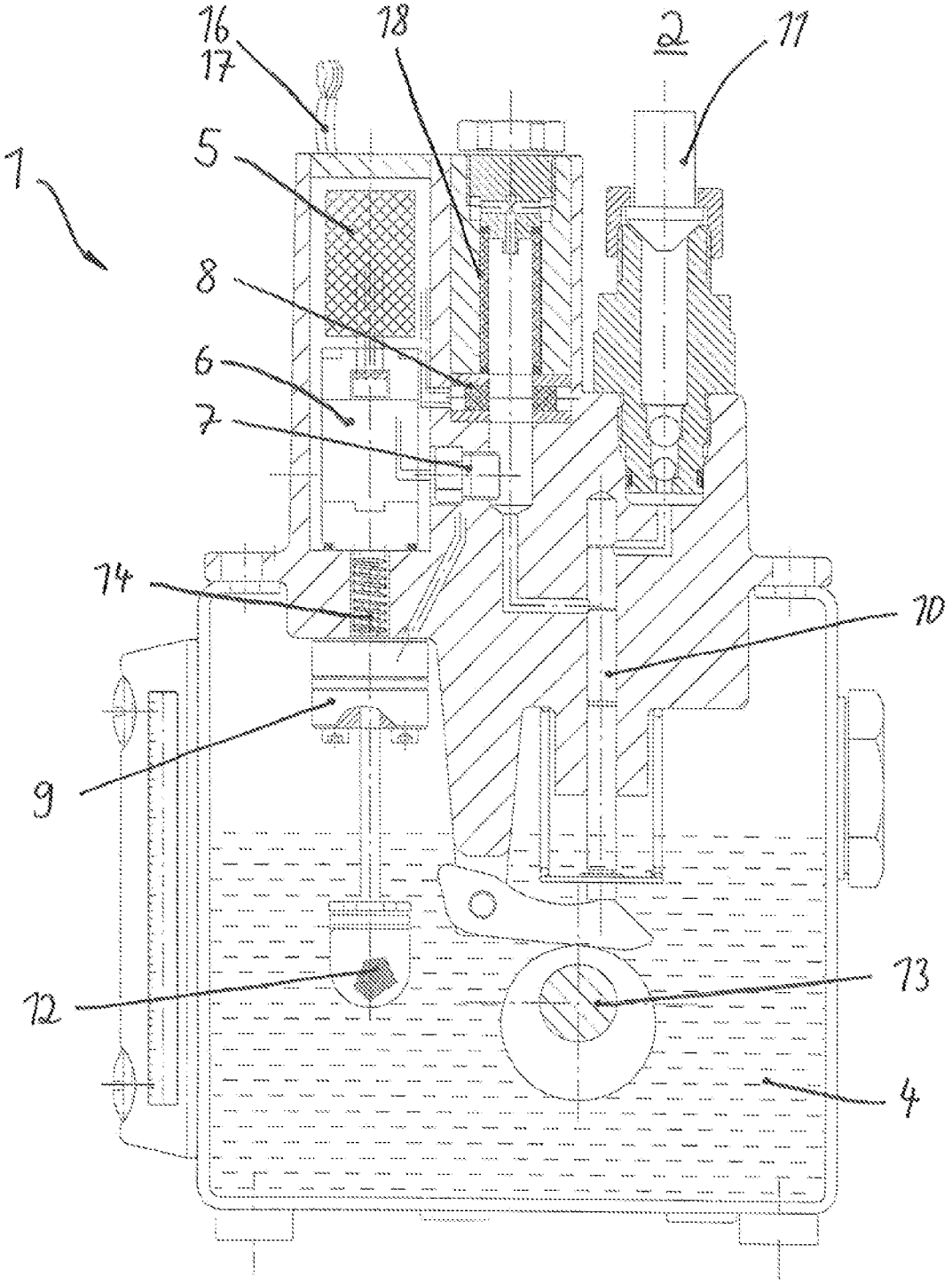
FIG. 3 shows a section through a lubricating device that operates according to the principle that is depicted in FIGS. 1 and 2.

In FIG. 3 a possible mechanical-engineering realization of the lubricating device can be seen. Here details are also visible, such as the lubricant outlet 11, the suction tube 12, the current terminal 16, and the data signals 17, as well as a sight glass 18 in the region of the volumetric-flow measuring element 8.

A self-regulating total loss oil lubrication system is thus realized, which can be especially advantageously used for the lubricating of a compressor.

The pumping volumetric flow of the total loss oil lubrication is variably adjustable and controllable in an electrical manner and reacts immediately to changing operating conditions using an internal control circuit and with precise quantities of lubricant.

REFERENCE NUMBER LIST

1 Lubricating device
2 Lubrication point
3 Feed pump
4 Lubricant reservoir
5 Controlling device/regulating device
6 Stepper motor
7 Measuring means (temperature sensor)
8 Measuring means (volumetric flow measuring element)
9 Gear pump
10 Pumping element (pressurizing piston)
11 Lubricant outlet
12 Suction tube
13 Actuator for pumping element (pressurizing piston)
14 Coupling
15 Signal line
16 Current terminal
17 Data signals
18 Sight glass
D Metering stage
P Pressure stage
T Operating parameter (temperature)
$\dot{V}_{target}$ required volumetric flow/target volumetric flow
$\dot{V}_{actual}$ actual current volumetric flow/actual volumetric flow

We claim:

1. A lubricant supply device, comprising:

a feed pump configured to pump lubricant from a lubricant reservoir;

at least one sensor configured to measure an operating parameter (T) of at least one part of a system to be lubricated; and a controller configured to: (i) determine, in accordance with the measured operating parameter, a target volumetric flow ($V_{target}$) of lubricant based on a stored function ($V_{target}=f(T)$) that relates the target volumetric flow ($V_{target}$) to the measured operating parameter (T) and (ii) to actuate the feed pump to achieve the target volumetric flow ($V_{target}$), wherein the controller is further configured to:

compare a measured current, actual volumetric flow being output from the feed pump to the target volumetric flow ($V_{target}$) for the currently measured operating parameter, and in case there is a deviation between these values, reduce the deviation by changing the output of the feed pump, and wherein the feed pump includes a gear pump operably driven by a stepper motor, wherein the controller is configured to output a step number per time, which corresponds to the target volumetric flow ($V_{target}$) for the currently measured operating parameter, to the stepper motor to drive the gear pump, and further comprising a reciprocating piston configured to pressurize the lubricant pumped by the gear pump.

2. The lubricant supply device according to claim 1, further comprising means for measuring the current, actual volumetric flow of lubricant being output from the gear pump and for feeding back the measured current, actual volumetric flow to the controller, wherein the means for measuring comprises a photoelectric sensor configured to measure lubricant drops.

3. A method for operating a total loss oil lubricating device configured to pump a lubricant to at least one lubrication point of a system to be lubricated, the lubricating device comprising a gear pump operably driven by a stepper motor and configured to supply the lubricant from a lubricant reservoir to the at least one lubrication point, wherein the method comprises:

a) measuring at least one operating parameter (T) of at least one part of the system to be lubricated;

b) determining a target volumetric flow ($V_{target}$) of lubricant based on a stored functional relationship ($V_{target}=f(T)$) between the required volumetric flow ($V_{target}$) and the operating parameter (T), and outputting a step number per time corresponding to the target volumetric flow;

c) activating the gear pump to provide the volumetric flow ($V_{target}$) of the lubricant determined according to step b) to the lubrication point, d) using a reciprocating piston to pressurize the lubricant pumped by the gear pump, e) measuring the current, actual volumetric flow (Actual) being output from the gear pump, and f) comparing the measured current, actual volumetric flow to the volumetric flow ($V_{target}$) determined according to step b), wherein in case there is a deviation between these values, reducing the deviation by changing the output of the gear pump.

4. The method according to claim 3 further comprising measuring the current, actual volumetric flow of lubricant being output from the gear pump using a photoelectric sensor to measure lubricant drops and feeding back the measured current, actual volumetric flow to the controller.

* * * * *